US012359331B2

(12) United States Patent
Wijenberg et al.

(10) Patent No.: US 12,359,331 B2
(45) Date of Patent: Jul. 15, 2025

(54) METHOD FOR ELECTRODEPOSITING A FUNCTIONAL OR DECORATIVE CHROMIUM LAYER FROM A TRIVALENT CHROMIUM ELECTROLYTE

(71) Applicant: TATA STEEL NEDERLAND TECHNOLOGY B.V., Velsen-Noord (NL)

(72) Inventors: Jacques Hubert Olga Joseph Wijenberg, Amsterdam (NL); Ganesan Palaniswamy, Haarlem (NL)

(73) Assignee: TATA STEEL NEDERLAND TECHNOLOGY B.V., Velsen-Noord (NL)

( * ) Notice: Subject to any disclaimer, the term of this patent is extended or adjusted under 35 U.S.C. 154(b) by 277 days.

(21) Appl. No.: 18/002,716

(22) PCT Filed: Jul. 15, 2021

(86) PCT No.: PCT/EP2021/069841

§ 371 (c)(1),
(2) Date: Dec. 21, 2022

(87) PCT Pub. No.: WO2022/013387

PCT Pub. Date: Jan. 20, 2022

(65) Prior Publication Data

US 2023/0243057 A1 Aug. 3, 2023

(30) Foreign Application Priority Data

Jul. 15, 2020 (EP) ..... 20185961

(51) Int. Cl.
*C25D 3/06* (2006.01)
*C25D 3/10* (2006.01)
(Continued)

(52) U.S. Cl.
CPC ..... *C25D 3/06* (2013.01); *C25D 3/10* (2013.01); *C25D 7/0614* (2013.01); *C25D 17/10* (2013.01); *C25D 21/12* (2013.01)

(58) Field of Classification Search
None
See application file for complete search history.

(56) References Cited

U.S. PATENT DOCUMENTS

2012/0024714 A1* 2/2012 Kwon ..... C25D 3/06 205/287
2013/0220819 A1* 8/2013 Hall ..... C25D 5/627 205/104

(Continued)

FOREIGN PATENT DOCUMENTS

DE 102008024271 A1 9/2009
EP 3428321 A1 1/2019

(Continued)

OTHER PUBLICATIONS

International Search Report mailed Oct. 20, 2021 for PCT/EP2021/069841 filed Jul. 15, 2021, 12 pages.

(Continued)

*Primary Examiner* — Louis J Rufo
(74) *Attorney, Agent, or Firm* — Vorys, Sater, Seymour and Pease LLP; Anthony P. Venturino; Maryellen Feehery Hank

(57) ABSTRACT

A method for the electrodeposition of a functional or decorative chromium layer onto a metallic substrate in an electrodeposition process from a halide-ion free and boric acid free aqueous electrolyte solution and to the coated product obtained thereby.

19 Claims, 3 Drawing Sheets

Figure 1:
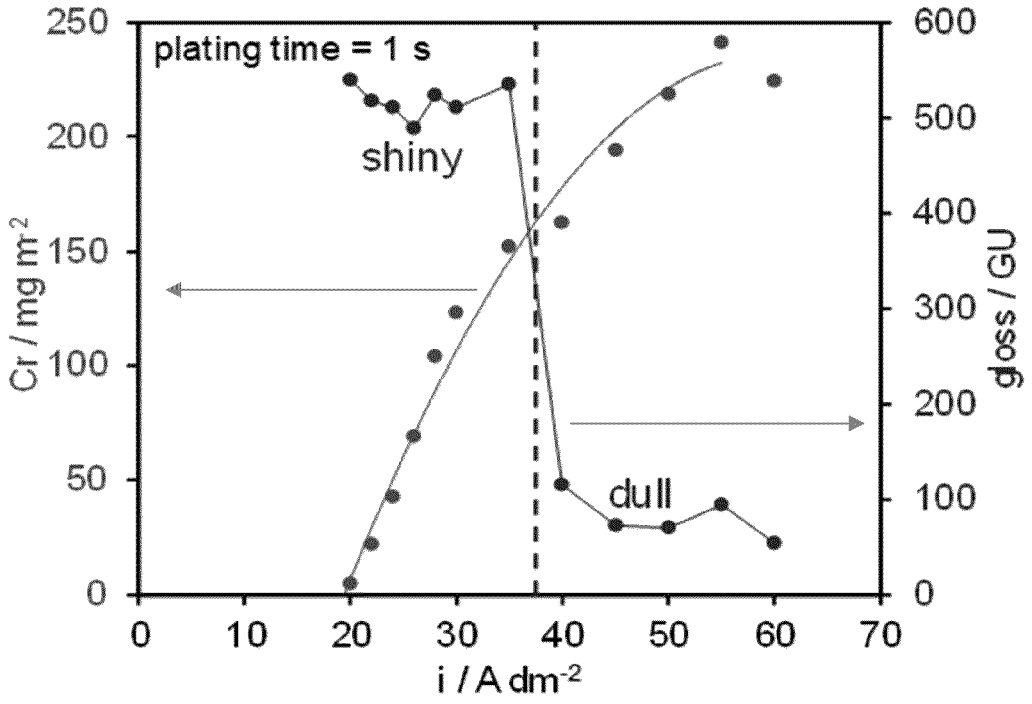

(51) Int. Cl.

| | |
|---|---|
| ***C25D 7/06*** | (2006.01) |
| ***C25D 17/10*** | (2006.01) |
| ***C25D 21/12*** | (2006.01) |

(56) References Cited

U.S. PATENT DOCUMENTS

| | | | | |
|---|---|---|---|---|
| 2016/0138178 | A1* | 5/2016 | Wijenberg ..... | C25D 5/623<br>205/199 |
| 2017/0009361 | A1 | 1/2017 | Dal Ziliio et al. | |

FOREIGN PATENT DOCUMENTS

| | | | |
|---|---|---|---|
| WO | 2015177314 | A1 | 11/2015 |
| WO | 2015177315 | A1 | 11/2015 |

OTHER PUBLICATIONS

Leimbach, Martin, "Low-frequency pulse plating for tailoring the optical appearance of chromium layers for decorative applications", Journal of Applied Electrochemistry, (2020) 50:489-499.

* cited by examiner

| # | SEM image |
|---|---|
| 1 |  <br>EHT = 5.00 kV Signal A = SE2 Mag = 11.43K X Width = 10.00 µm<br>I Probe – 150 pA WD = 4.6 mm Pixel Size = 9.766 nm Height = 7.500 µm |
| 2 |  <br>EHT = 5.00 kV Signal A = SE2 Mag = 11.43K X Width = 10.00 µm<br>I Probe – 150 pA WD = 4.5 mm Pixel Size = 9.766 nm Height = 7.500 µm |

METHOD FOR ELECTRODEPOSITING A FUNCTIONAL OR DECORATIVE CHROMIUM LAYER FROM A TRIVALENT CHROMIUM ELECTROLYTE

FIELD OF THE INVENTION

This invention relates to a method for electrodepositing a functional or decorative chromium layer from a trivalent chromium electrolyte onto a metallic substrate.

BACKGROUND OF THE INVENTION

Hexavalent chromium electrodeposition has been used for many years to provide decorative, durable coatings with excellent wear and corrosion resistance properties. However, hexavalent chromium baths have come under increasing scrutiny due to the toxic nature of the bath, effects on the environment, and workers' health.

So for health & safety reasons the chromium coating must be applied from a Cr(III) electrolyte. Many commercial Cr(III) electrolytes for applying decorative chromium coatings are available in the market. Typical applications are automotive parts (interior and exterior), sanitary and plumbing fixtures, furniture, and hand tools.

For specific applications such as the production of photovoltaic devices on mild steel substrates, there is a need for applying a diffusion barrier layer. Such a barrier layer prevents diffusion of iron or other detrimental elements from the steel substrate to the solar cells that are deposited at a temperature up to 600° C. One of the barrier layer combinations is a chromium layer on a nickel-plated steel substrate. The term "detrimental" element means an element that adversely affects the efficiency of the solar cell.

The distinction between functional and decorative chromium layers is generally considered to be as follows:

| Type of coating | Thickness range (μm) | |
|---|---|---|
| functional (hard) | 0.5-1000 | hardness<br>corrosion resistance<br>wear resistance<br>heat resistance |
| decorative | 0.1-1 | appearance<br>corrosion resistance |

Decorative chromium coatings are usually applied on a duplex nickel base coating. The nickel layer provides corrosion resistance and levelling of the substrate surface. The principle is that by applying two nickel layers, the first being semi-bright with a columnar structure (13-30 μm), the second being bright with a laminar structure (5-20 μm), exceptional corrosion resistance is obtained, because the bright nickel offers cathodic protection to the semi-bright nickel. The bright nickel acts as the anode and sacrificially protects the semi-bright nickel. This results in corrosion spreading laterally rather than penetrating the substrate. Decorative chromium coatings have numerous micro-cracks and micro-pores. Since these micro-defects are uniformly spread over the chromium surface, corrosion is not localised and therefore proceeds slowly.

Unfortunately, the commonly used commercial Cr(III) electrolytes for depositing functional or decorative chromium coatings have drawbacks:

i) Complex electrolyte chemistry (many components), amongst which a buffer, difficult to control, maintain, and replenish.

ii) Cr(III) electrolytes usually contain boric acid as buffer. Due to the toxic and hazardous potential of boric acid it would be desirable to avoid its presence in the electrolyte;

iii) Chloride based electrolytes: risk of chlorine evolution at the anodes, a depolariser (bromide is often used for this purpose) is required to suppress Cr(VI) formation at the anode, and moderate chromium deposition rates (0.2 μm $min^{-1}$);

iv) Sulphate based electrolytes: low chromium deposition rates (0.05 μm $min^{-1}$);

v) Commercially available trivalent chromium baths often result in cracked coatings after a heat treatment.

Objectives of the Invention

It is the object of the invention to electrodeposit a decorative or functional chromium layer from an electrolyte solution comprising a trivalent chromium compound on a metallic substrate.

It is also an object of the invention to electrodeposit a decorative or functional chromium layer from an electrolyte solution comprising a trivalent chromium compound and a minimum of other compounds on a metallic substrate for use in photovoltaic applications.

It is also an object of the invention to provide a REACH compliant method for electrodepositing a decorative or functional chromium layer on a metallic substrate.

It is also an object of the invention to provide a method for electrodepositing a decorative or functional chromium layer on a metallic substrate which has a higher deposition rate than known methods.

DESCRIPTION OF THE INVENTION

One or more of the objects is reached with a method for the electrodeposition of a functional or decorative chromium layer onto a metallic substrate in a batch or a continuous electrodeposition process from a halide-ion free and boric acid free aqueous electrolyte solution comprising:

i) a trivalent chromium compound provided by a water-soluble chromium(III) salt wherein the electrolyte solution contains at least 50 mM and at most 1000 mM $Cr^{3+}$-ions;

ii) a total amount of from 25 to 2800 mM of sodium sulphate or potassium sulphate;

iii) a formate salt as a complexing agent at a $$\left(\frac{\text{complexing agent}}{Cr^{3+}}\right)$$

molar ratio of at least 1:1 and at most 4.0:1.0 (or 4:1);

iv) optionally sulphuric acid or sodium hydroxide or potassium hydroxide to adjust the pH to the desired value;

v) optionally a surfactant to facilitate the release of hydrogen gas bubbles from the substrate, wherein the aqueous electrolyte solution has a pH of between 1.50 and 3.00 measured at 25° C. and wherein the temperature of the aqueous electrolyte solution during electrodeposition is between 30 and 60° C., wherein the substrate acts as a cathode and wherein one or more anodes comprising a catalytic coating of i). iridium oxide or ii). a mixed metal oxide comprising iridium oxide and tantalum oxide for reducing or eliminating the oxidation of $Cr^{3}$+-ions to $Cr^{6}$+-ions, and wherein the electrodeposition is performed by means of pulsed electrodeposition comprising two or more current pulses at a selected current density for a selected pulse duration, wherein each current pulse (the "on-time") is followed by an interpulse period (the "off-time") wherein the current density is set to 0.

A practical minimum off-time is 0.1 s. A shorter time will not result in the required relaxation of concentration gradients including the pH in the diffusion boundary layer near the cathode and the establishment of new chemical equilibria of Cr(III) complexes during the time period wherein the current is switched off.

The use of a trivalent chromium compound renders the method REACH compliant as the use of hexavalent chromium in the electrolyte is avoided. The absence of halide-ions in the electrolyte prevents the formation of toxic gases such as chlorine and bromine at the anode. Also, a buffering agent, such as the often-used boric acid ($H_3BO_3$), is not present in the electrolyte to prevent hexavalent chromium formation at the anode during electrodeposition. Even without boric acid chromium metal will be deposited under the conditions of the method according to the invention. The electrolyte does not contain a depolarizer, such as potassium bromide. The absence of this compound prevents the risk of bromine formation at the anode.

The electrodeposition process may be a batch electrodeposition process or a continuous electrodeposition process.

The preferred metallic substrate is an unalloyed or low-alloyed steel substrate. The steel substrate can be of varying thickness, preferably from 25 μm to 3 mm. The lower thickness forms a flexible solar module, whereas thicknesses of over 0.3 mm can take a rigid form or even be directly integrated to building elements, in which case an electrically insulating layer is applied. The unalloyed or low-alloyed steels comprise unalloyed or low-alloy steel mild steel, low carbon (LC), extra low-carbon (ELC) or ultra-low carbon (ULC) could be used, such as the steels DC01 to DC07 as defined by EN 10130:2006, e.g. in table 2. Preferably the surface condition of the steels is bright ($R_a \leq 0.4$ μm, EN 10130:2006) or mirror-like ($R_a \leq 0.10$ μm, more preferably $R_a \leq 0.08$ μm) to minimise the possible negative effects of surface roughness. The unalloyed or low-alloyed steels also include cold-rolled structural steels or a high strength low alloy (HSLA) steel could also be chosen. These may be used if a higher strength of the steel substrate is needed. For the sake of avoiding any misunderstanding: the unalloyed or low-alloyed steel substrate steel types referred to above specifically exclude stainless steels. Stainless steel is an alloyed steel with a minimum of 10.5 wt. % Cr. Chromium is expensive. The method according to the invention allows to use a less expensive steel substrate than stainless steels and still provide the required corrosion properties and protection against poisoning of a photovoltaic device provided on top of the steel. The metallic substrate that has been provided with a functional or decorative chromium layer according to the invention can also be used for other applications where the functional and/or decorative properties of a chromium layer are required.

Pulsed electrodeposition in the context of this invention comprises or consists of a plurality of current pulses (i.e. two or more) at a selected current density for a selected pulse duration each current pulse followed by an interpulse period wherein the current density is set to 0. It should be noted that the current density of 0 in the interpulse period encompasses a very low current density, cathodic or anodic, which has no material effect on the electrodeposition in the interpulse period and has the same technical effect as a current density of exactly 0. This is because the interrupted electrodeposition process causes a relaxation of concentration gradients including the pH in the diffusion boundary layer near the cathode and the establishment of new chemical equilibria of Cr(III) complexes during the time period wherein the current is switched off, and this happens at a current density of 0, but the same effect also occurs at very low current densities in the interpulse period. However, there appears to be no technical benefit in deliberately choosing such a very low current density, and therefore the preferred embodiment is to choose a current density of 0 in the interpulse period.

The terms "comprises" and variations thereof do not have a limiting meaning where these terms appear in the description and claims. When the term is used for a composition, the term "comprises" means that at least the components as recited are present in the amounts or within the ranges as recited. The term "consists of" and variations thereof have a limiting meaning where these terms appear in the description and claims. When the term is used for a composition, the term "consists of" means that the components as recited are present in the amounts or within the ranges as recited and that no other components are present at all, unless indicated as an optional element, in which case it may be present in the given amounts or not at all, or at least not in an amount that materially affects the working of the claimed invention. This also means that inevitable impurities or ineffective additions of components are deemed to not materially affect the way the invention works. This is to prevent the addition of components that do not materially affect the way the invention works, which may be added solely with the aim to easily circumvent the claims by adding materially inactive components. The term "consisting only of" and variations thereof have a limiting meaning where these terms appear in the description and claims, and means that only the components as recited are present in the amounts or within the ranges as recited and that no other components are present, with the exception of inevitable impurities.

The term "halide-ion and boric acid free" electrolyte means that the aqueous electrolyte contains no halide-ions and no boric acid in an amount that materially affects the way the invention works. The claimed buffering action in prior art electrolytes of boric acid is not necessary and not even desired in the electrolyte and method according to the invention.

In an embodiment of the invention the aqueous electrolyte solution consists of, and preferably consists only of:

i) the trivalent chromium compound provided by a water-soluble chromium(III) salt wherein the electrolyte solution contains at least 50 mM and at most 1000 mM $Cr^{3}$+-ions;

ii) a total amount of from 25 to 2800 mM of sodium sulphate or potassium sulphate;

iii) a formate salt as a complexing agent at a $$\left(\frac{\text{complexing agent}}{Cr^{3+}}\right)$$

molar ratio of at least 1:1 and at most 4.0:1;

iv) optionally sulphuric acid or sodium hydroxide or potassium hydroxide to adjust the pH to the desired value;

v) optionally a surfactant to facilitate the release of hydrogen gas bubbles from the substrate;

vi) remainder inevitable impurities.

In an embodiment the pulse duration in a batch electrodeposition process is between 0.1 and 2.5 seconds and preferably between 0.5 and 2.5 seconds, and the interpulse period is between 0.1 and 5 seconds and preferably between 0.5 and 5 seconds.

In an embodiment wherein the pulse duration in a continuous electrodeposition process is between 0.1 and 2.5 seconds and preferably between 0.5 and 2.5 seconds, and the interpulse time is between 0.1 and 5 seconds and preferably between 0.5 and 5 seconds.

In a preferable embodiment the pulse duration in the continuous electrodeposition process is between 0.1 and 2 seconds and preferably between 0.5 and 2 seconds, and the interpulse time is between 0.1 and 2 seconds and preferably between 0.5 and 2 seconds.

In a preferred embodiment the aqueous electrolyte solution (also referred to as "the electrolyte" in this description) consists of the compounds in the ranges as mentioned hereinabove in the range, and more preferably consists only of the compounds in the ranges as mentioned hereinabove in the range.

Preferably the temperature of the electrolyte during electrodeposition is at most 55° C., more preferably at most 50° C. A suitable minimum temperature of the electrolyte during electrodeposition is 35° C.

Preferably the electrolyte has a pH of 2.00 or more and or 3.00 or less. All references to pH relate to the pH value as measured at 25° C. More preferably the pH is between 2.25 and 2.75.

It is noted that the optional sulphuric acid or sodium hydroxide or potassium hydroxide only needs to be added if the pH has to be adjusted to the desired value. If the pH is already at the desired value, then no such addition will be needed.

The complexing agent is a formate salt, preferably a sodium or potassium formate.

Preferably the ratio of molar complexing agent to $Cr^{3}$+ is 2.0:1.

The optional surfactant can be added if required and is added to promote the release of hydrogen gas bubbles, formed during the electrodeposition, from the substrate. By means of a non-limiting example the inventors used TriChrome Regulator LR in an amount of between 2-4 ml/l in accordance with the recommendations of the technical datasheet as provided by the supplier. Other surfactants are available and the skilled person will have no problem selecting a suitable one and amounts to be added in accordance with the relevant the technical datasheet. The inventors noted that a surfactant is generally not needed in a continuous process where the inherent relative movement between the electrolyte and the substrate already removes any bubbles from the substrate, particularly if the substrate is a strip and the continuous process is performed in a strip electrodeposition line.

For use in photovoltaic applications the chromium coating thickness should be between 10 and 1000 nm. If the chromium coating is defect free, it may serve as a barrier layer on its own. However, in many cases a nickel layer between the substrate and the chromium layer is preferably used, wherein the chromium and nickel layer together form the barrier layer. The nickel layer smoothens out the steel substrate and offers a degree of insurance in case the chromium layer, despite all due care, contains some defect or pinhole. The underlayer is not particularly restrictive as long as the underlayer provides a smooth and defect free layer between the steel substrate and the chromium layer on top. Copper layers of between 50 and 300 nm have also shown to be useful and effective as underlayers. Preferably the Cu-layer is between 50 and 150 nm (e.g. about 100 nm) and the subsequent Cr-layer is between 450 and 550 nm (e.g. about 500 nm).

In the barrier layer according to the invention the nickel layer thickness is between 0.25 and 5.5 μm, and the chromium layer thickness is between 0.01 μm (10 nm) and 1.0 μm (1000 nm). In the presence of a dielectric layer the Ni and Cr layer can be thinner than without a dielectric layer. A suitable minimum chromium layer thickness is 15 nm. A suitable maximum chromium layer thickness is at most 800 nm, preferably at most 700 nm. A suitable minimum nickel layer thickness is 0.4 μm. A suitable maximum nickel layer thickness is at most 3.5 μm, preferably at most 2.5 μm.

In a preferable embodiment the nickel layer thickness is between 1.75 and 2.5 μm and/or the chromium layer thickness is between 0.450 and 0.550 μm. These layer thicknesses are particularly suitable for production of PV-modules requiring a high process temperature (such as in CIGS solar technology). For the monolithical module making approach there must be a dielectric layer and therefore the nickel and chromium layers can be thinner, and the dielectric layers also prevents the movement of detrimental elements, such as iron and manganese, to the CIGS layer, depending on the nature of the coating.

The chromium coating must be defect free and crack free to prevent the steel substrate interfering with the functioning of the PV-application. Commercially available trivalent chromium baths resulted in cracked coatings, either already before or after the annealing, depending on the thickness.

If the cold rolled steel substrate needs to be recrystallisation annealed or recovery annealed, then this has to be done before applying the optional nickel layer or the optional copper layer and the chromium layer, because otherwise detrimental elements may diffuse into the nickel, copper or chromium layer during the recrystallisation annealing or recovery annealing and diffuse through the molybdenum back contact layer during the growing of the CIGS absorber layer and finally potentially end up in the CIGS absorber layer. The inventors found that it is important to keep the iron content in the CIGS absorber layer as low as possible, preferably below 20 ppm, more preferably below 7 ppm.

When the nickel, copper and chromium layers are defect free, they should reduce diffusion of elements (Fe, Mn, etc.) from the substrate to (ideally)<10 ppm, because these detrimental elements negatively impact the efficiency of the PV-application.

The chromium coatings deposited according to the invention provide good protection against the diffusion of elements from the steel substrate up to the maximum temperature of 650° C.

The method according to the invention is suitable for use in a batch type process, for instance for rack electrodeposition or piecewise electrodeposition and in a continuous process, for instance for electrodeposition of strip material.

In an embodiment of the invention the line speed of the electrodeposition line in the continuous electrodeposition process is at least 50 m/min, preferably at least 100 m/min.

EXAMPLES

Two variants of HILAN® nickel plated steel coil were used as substrate: a variant with a high surface roughness and a dull surface appearance (Ra. min 0.6 and max. 2.5 μm) and a bright finish variant with a low surface roughness and a shiny appearance (Ra≤0.2 μm). Tata Steel's HILAN® is a cold-rolled steel strip product electroplated with bright nickel. Bright nickel creates an extra hard and extra bright surface and is suitable for stamping and deep-drawing operations. It is produced by electrodepositing a bright nickel layer of between 0.5 and 3.0 μm on a cold-rolled steel strip which offers low contact resistance and high corrosion resistance.

The material was activated in a 50 g/l sulphuric acid solution by dipping it for 10 seconds in the solution at room temperature. After activation a Woods nickel strike layer was applied in an electrolyte at 30° C. at a cathodic current density of 10 A/dm$^2$ with nickel anodes. The aqueous electrolyte comprises 240 g/l nickel(II)chloride hexahydrate and 125 ml/l of hydrochloric acid 37%

The aqueous electrolyte solution for electrodeposition of the chromium coating is prepared as follows:

TABLE 1

30 g/l Cr electrolyte with a formate/Cr ratio of 2.0 (surfactant (V) is optional).

| order | compound | concentration |
|---|---|---|
| I | Sodium formate HCOONa | 1154 mM |
| II | Basic chromium sulphate $(CrOHSO_4)_2 \times Na_2SO_4$ | 577 mM Cr(III) |
| III | Sodium sulphate | 1041 mM |
| IV | Sulphuric acid | pH 2.45 |
| V | TriChrome Regulator LR | 3 ml/l (optional) |

The electrolyte was treated to remove sulphite as disclosed in EP3428321-A1 and the electrolyte temperature was 43° C.

The chromium coating weight was measured with Inductively Coupled Plasma—Mass Spectrometry (ICP-MS), a benchtop spectrometer (SPECTRO XEPOS) or with a Byk handheld XRF-spectrometer (type 4443). The inventors observed that the values obtained with the ICP-MS are directly proportional to the total electrodeposition time and the current efficiency corresponds to the current efficiency from previous experiments and the current efficiency reported in literature. The chromium coating weight tends to be underestimated when being measured with the XRF-spectrometer, but a simple calibration allows comparing the benchtop values and the handheld values to the values measured with the ICP-MS.

The inventors found that when the nickel plated substrates were plated in this solution for an electrodeposition time of 1 second that the chromium layer had a shiny appearance at low current densities, but this shifted quite quickly to a dull appearance at higher current densities or longer electrodeposition times. This means that the thickness of a shiny layer is limited (see FIG. 1) when electrodeposition in this manner. This transition from a shiny to a dull appearance can be easily seen by the naked eye and is confirmed by gloss measurements. The highest chromium coating weight having a shiny appearance that could be obtained was about 150 mg/m$^2$.

Figure 2:
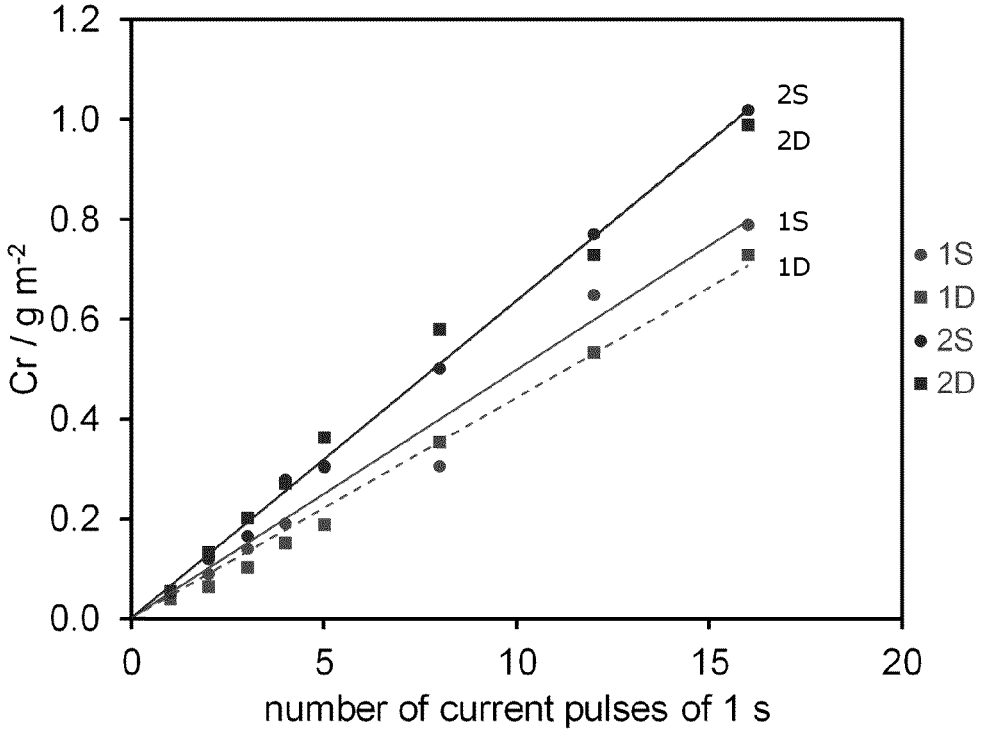

The inventors also found that shiny coatings can be obtained at longer aggregated electrodeposition times when the current is interrupted. During the interruption the hydrogen that also evolves during electrodeposition forms bubbles on the surface and these bubbles are being stimulated to come off the metallic substrate which is being plated, e.g. by means of agitation, a shaking action or a mechanical action. The next electrodeposition step can then be performed on a surface free from hydrogen bubbles each time. The inventors consider this removal of the hydrogen bubbles as very important in the production of a bright chromium plated surface. The intermittent removal of hydrogen and intermittent electrodeposition results in a very shiny surface and also in much thicker chromium layers (FIG. 2). There appears to be no limit to the thickness of the chromium layer when applied in this way and layers up to 2 μm could be applied.

For decorative chromium electrodeposition, colour is one of the most important coating properties. It is desired that the colour from Cr(III) electrolytes is close to the colour from Cr(VI) electrolytes, because this allows different parts plated from Cr(III) and Cr(VI) electrolytes to be combined without perceivable colour differences.

In Table 2, the results of some colour and gloss measurements to get an impression. Some of these measurements are plotted in FIG. 1 (indicated with *). An objective assessment of the gloss of smooth surfaces can be obtained with a reflectometer operating according to ISO 2813:2014 such as the Byk micro-TRI-gloss from BYK-Gardner GmbH, where the angle of the measurement (20, 60 or 85°) is chosen depending on the level of reflectivity. Gloss is defined as an optical property of a surface, characterised by its ability to reflect light specularly (ISO4618:2014). ISO 2813 defines the three measuring angles and prescribed to use an angle of 20° for high-gloss samples and 60° for medium-gloss samples. The reflectometer yields gloss unit values as listed in table 2.

TABLE 2

Results of colour and gloss measurements.

| i A/dm$^2$ | t s | $t_{off}$ s | # — | Cr mg/m$^2$] | L | a | b | gloss unit | shiny | angle ° | FIG. 1 |
|---|---|---|---|---|---|---|---|---|---|---|---|
| 26 | 1.0 | 10.0 | 4 | 386 | 83.64 | −0.01 | 1.26 | 1152 | yes | 20 | |
| 26 | 1.0 | 10.0 | 6 | 753 | 84.01 | −0.02 | 1.10 | 1173 | yes | 20 | |
| 26 | 1.0 | 10.0 | 8 | 1014 | 84.25 | −0.03 | 0.99 | 1164 | yes | 20 | |
| 35 | 1.0 | — | 1 | 125 | 77.75 | −0.36 | 1.22 | 881 | yes | 20 | |
| 35 | 2.0 | — | 1 | 384 | 60.71 | −1.11 | 3.94 | 24 | no | 60 | |
| 35 | 3.0 | — | 1 | 461 | 63.18 | 2.82 | 5.24 | 14 | no | 60 | |
| 20 | 1.0 | — | 1 | 5 | 79.76 | 1.13 | 8.83 | 1054 | yes | 20 | * |
| 22 | 1.0 | — | 1 | 22 | 78.45 | 1.19 | 8.24 | 841 | yes | 20 | * |
| 24 | 1.0 | — | 1 | 43 | 78.38 | 0.87 | 5.22 | 912 | yes | 20 | * |
| 26 | 1.0 | — | 1 | 69 | 77.38 | 0.39 | 3.15 | 953 | yes | 20 | * |
| 28 | 1.0 | — | 1 | 104 | 79.64 | 0.02 | 1.65 | 1025 | yes | 20 | * |
| 30 | 1.0 | — | 1 | 123 | 80.91 | −0.49 | 0.24 | 891 | yes | 20 | * |
| 35 | 1.0 | — | 1 | 152 | 81.05 | −0.17 | 1.28 | 1001 | yes | 20 | * |
| 40 | 1.0 | — | 1 | 163 | 68.29 | −0.91 | 2.11 | 115 | no | 60 | * |

TABLE 2-continued

Results of colour and gloss measurements.

| i A/dm$^2$ | t s | $t_{off}$ s | # — | Cr mg/m$^2$] | L | a | b | gloss unit | shiny | angle ° | FIG. 1 |
|---|---|---|---|---|---|---|---|---|---|---|---|
| 45 | 1.0 | — | 1 | 194 | 66.08 | −0.68 | 3.04 | 73 | no | 60 | * |
| 50 | 1.0 | — | 1 | 218 | 63.71 | −0.62 | 3.53 | 71 | no | 60 | * |
| 55 | 1.0 | — | 1 | 241 | 64.41 | −0.60 | 3.45 | 95 | no | 60 | * |
| 60 | 1.0 | — | 1 | 225 | 60.00 | −0.28 | 5.10 | 54 | no | 60 | * |
| 32 | 1.0 | 2.0 | 32 | 3652 | 84.28 | 0.00 | 0.92 | 1158 | yes | 20 | |
| 32 | 1.0 | 2.0 | 32 | 4351 | 84.29 | 0.00 | 0.87 | 1149 | yes | 20 | |

In this table the current density (i) and the pulse time (t), the interpulse time ($t_{off}$) and the number of pulses (#) is shown. The amount of Cr deposited and the parameters L, a and b are the parameters of the CIELAB color space. The gloss unit (GU) is the result of the reflectometer and the angle is the angle used for the measurement. The "shiny" column is a human interpretation of the deposited layer and is either "shiny" or "dull". The last column indicates which measurements are presented in FIG. 1.

These results show that thicker and shiny chromium layers can be deposited by means of the interrupted electrodeposition process using the trivalent chromium electrolyte according to the invention, and that layers of more than 4000 mg/m$^2$ can be easily obtained. The preferred "on-time" lies between 0.1 and 2 seconds.

The explanation that the inventors provide for this significant improvement is that the interrupted electrodeposition process causes a relaxation of concentration gradients including the pH in the diffusion boundary layer near the cathode and the establishment of new chemical equilibria of Cr(III) complexes during the time period wherein the current is switched off. Also, the interruption allows the hydrogen that has evolved during the electrodeposition to dissipate, move away from the cathode surface, or be actively removed from the cathode surface. This results in preventing the formation of chromium-oxide during the electrodeposition. Evidence is provided by XPS results performed on two samples (corresponding SEM images are provided in FIG. 4). Clearly, the dull sample contains a massive amount of chromium oxide, and the shiny sample does not. The electrolyte composition, temperature, pH and current density in both examples in table 3 are identical.

TABLE 3

Composition of shiny and dull substrate.

| # | $t_{on}$ s | # | $t_{off}$ s | Cr g/m$^2$ | Cr Metal (%) | Cr Carbide (%) | Cr Oxide (%) | Cr Sulphate (%) | visual |
|---|---|---|---|---|---|---|---|---|---|
| 1 | 10 | 1 | — | 795 | 44.7 | 7.0 | 46.5 | 1.8 | dull |
| 2 | 1 | 10 | 10 | 995 | 87.0 | 11.8 | 1.0 | 0.2 | shiny |

Known trivalent chromium electrolytes for electrodeposition decorative chromium layers contain boric acid as a buffer. This ensures that the pH in the diffusion boundary layer is maintained at a set value. In this known technology this is a prerequisite for depositing Cr-metal, because the prior art states that without these buffers mainly or only chromium oxide is deposited.

The process according to the invention shows that it is possible to deposit decorative chromium layers without this boric acid buffer, thereby simplifying the electrolyte.

The inventors also found that the total process time of the interrupted electrodeposition process can be limited by adding a surfactant to the electrolyte. This surfactant facilitates the removal of the hydrogen that has evolved during the electrodeposition. In most cases the interpulse time can be reduced to below 2 seconds.

If the interpulse time becomes too short, then the hydrogen cannot be removed sufficiently effectively, and the establishment of new chemical equilibria of Cr(III) complexes during the time period wherein the current density is 0 is not obtained. This leads to a dull surface of the chromium layer. The preferred interpulse time ("off-time") lies between 0.1 and 2 seconds.

Figure 3:
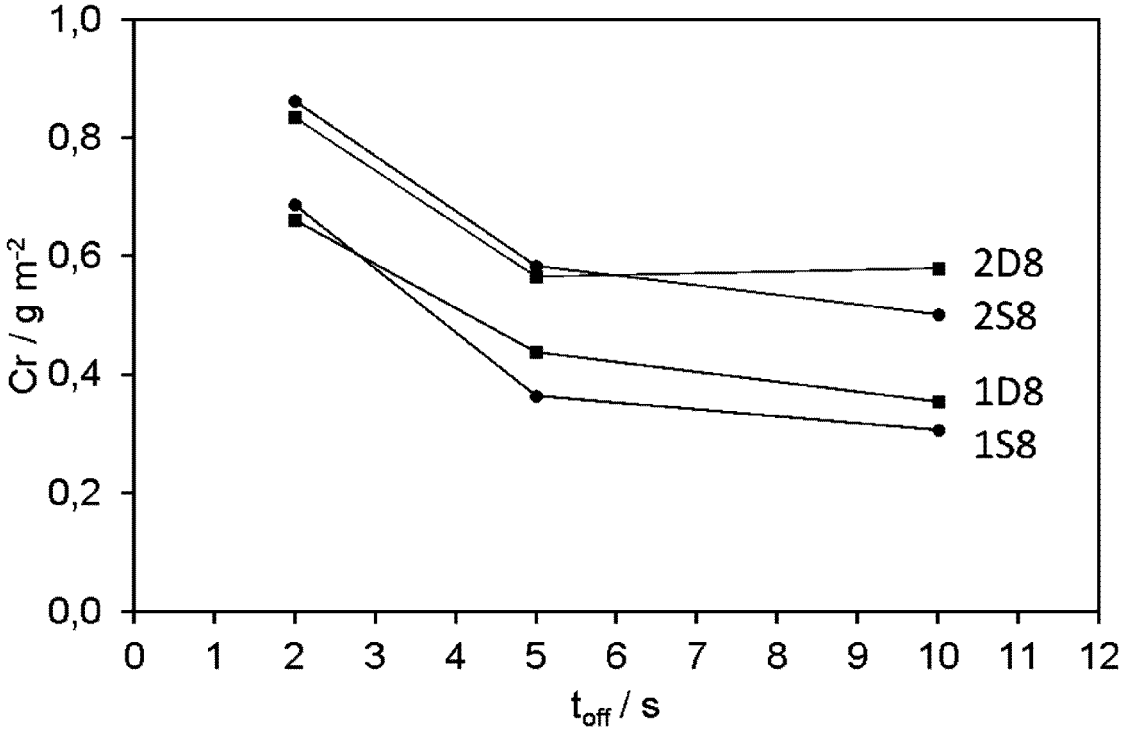

If the time between the pulses becomes too long, then full equilibrium is reached again. The pH at the diffusion boundary layer near the cathode drops to the average value of the electrolyte. This means that with the next pulse the pH at the cathode needs to increase first (obtain a lower pH value) before electrodeposition starts. This results in a loss of efficiency of the process, and this is shown in FIG. 3. This figure shows the chromium coating weight for 8 and 20 current pulses of 26 A/dm$^2$ and 1 s. Clearly, the chromium coating weight decreases strongly when the off-time is extended from 2 to 5 s. The same, but to a lesser extent, happens when the off-time is further extended to 10 s.

In FIG. 2 the relation is shown between the number of pulses and the amount of chromium deposited for a current density of 26 A/dm$^2$, an "on-time" of 1 s and an off-time of 10 s. The chromium coating weight is directly proportional to the number of current pulses. For different values of current densities and combination of on- and off-time similar proportional relationships were found.

A comparison of the deposition rate of the electrolyte according to the invention with commercially available electrolytes shows that the deposition rate obtainable with the inventive method is much higher. The inventors obtained deposition rates of up to 0.40 μm/min. Experiments with the commercially available sulphate based Trylite® Flash SF by MacDermid Enthone show that a deposition rate of 0.05 μm/min can be obtained under optimum conditions (deposition temperature 60° C., cathodic current density 10 A/dm$^2$, anodic current density 3 A/dm$^2$ and a pH of 3.7.). This electrolyte contains boric acid and Trylite specific compounds.

FIGURES

The invention is further explained by means of the following, non-limitative figures.

FIG. 1: Single pulse electrodeposition process with pulse duration of 1 second as a function of current density. Left hand side: Chromium coating weight in mg/m$^2$, right hand side: gloss expressed in GU (Gloss Units).

FIG. 2: Relation between the number of pulses and the chromium coating weight deposited for a current density of 26 A/dm$^2$, pulse durations of 1 s and an interpulse time of 10 s. The top line presents the ICP-MS measurements, the middle line presents the benchtop XRF measurements and the lower line presents the handheld measurements.

FIG. 3: Loss in process efficiency with increasing interpulse time. S means that the underlying nickel layer of the Hilan was shiny (see table 3) and D that the underlying nickel layer was dull. 8 and 20 mean the number of is pulses of 26 A/dm$^2$ used to deposit the chromium layer.

Figure 4:
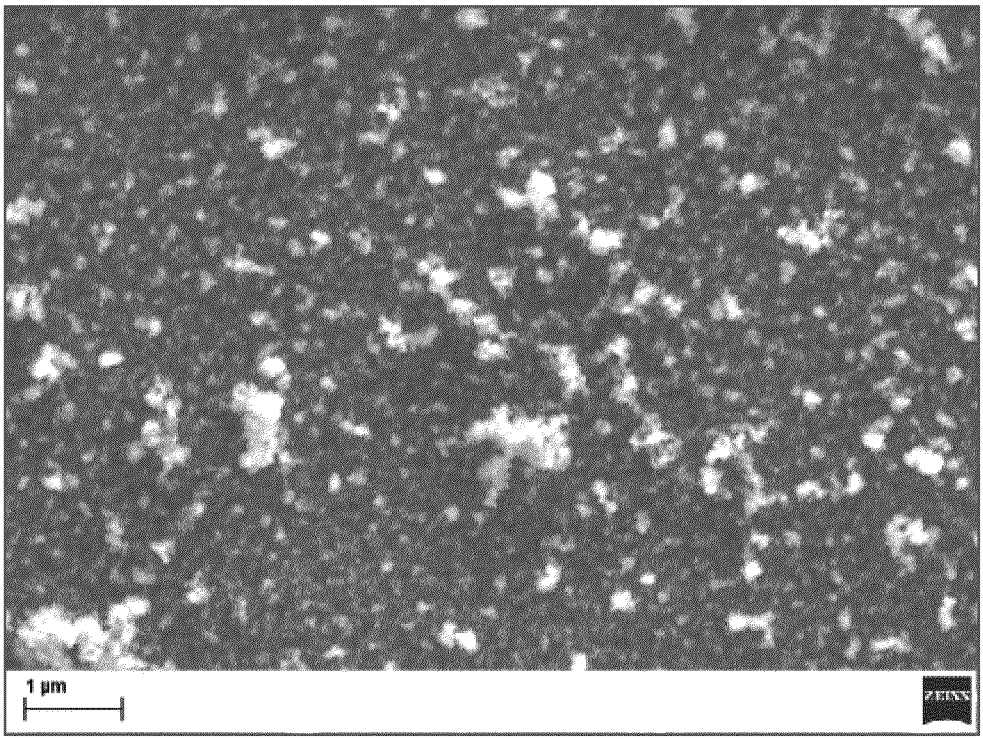
Figure 4:
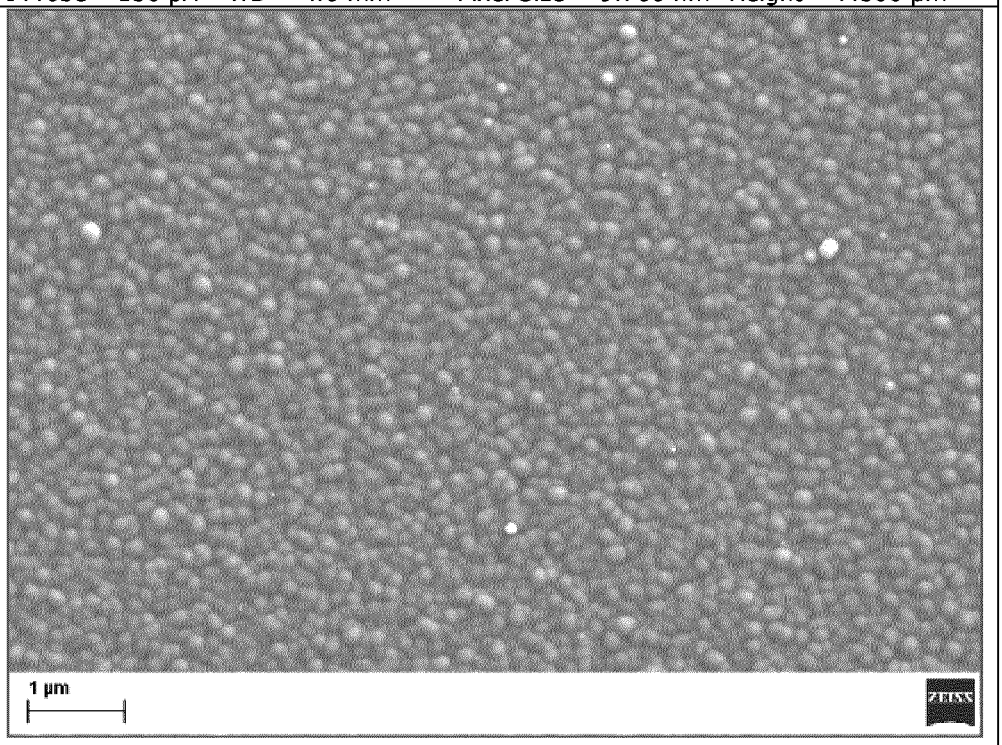

FIG. 4: SEM images of chromium surface obtained by single-pulse process vs multi-pulse process. Both images have been made at the same magnification. The measurement bar represents 1 μm. The Zeiss equipment was operated at an EHT of 5.00 kV, Signal A=SE2, Magnification of 11430 x, and the size of the observed specimen is 10.00× 7.500 μm$^2$. The I Probe was 150 pA, and the WD is 4.6 mm. Pixel size 9,766 nm).

The invention claimed is:

1. A method for the electrodeposition of a functional or decorative chromium layer onto a metallic substrate in a batch or a continuous electrodeposition process from a halide-ion free and boric acid free aqueous electrolyte solution, the electrolyte comprising:

i) a trivalent chromium compound provided by a water-soluble chromium(III) salt wherein the electrolyte solution contains at least 50 mM and at most 1000 mM Cr3+-ions;

ii) a total amount of from 25 to 2800 mM of sodium sulphate or potassium sulphate;

iii) a formate salt as a complexing agent at a $$\left(\frac{\text{complexing agent}}{Cr^{3+}}\right)$$

molar ratio of at least 1:1 and at most 4.0:1;

iv) optionally sulphuric acid or sodium hydroxide or potassium hydroxide to adjust the pH to the desired value;

v) optionally a surfactant to facilitate the release of hydrogen gas bubbles from the substrate, wherein the aqueous electrolyte solution has a pH of between 1.50 and 3.00 measured at 25° C. and wherein the temperature of the aqueous electrolyte solution during electrodeposition is between 30 and 60° C., wherein the substrate acts as a cathode and wherein one or more anodes comprising a catalytic coating of i). iridium oxide or ii). a mixed metal oxide comprising iridium oxide and tantalum oxide for reducing or eliminating the oxidation of Cr3+-ions to Cr6+-ions, and wherein the electrodeposition is performed by means of pulsed electrodeposition comprising two or more current pulses at a selected current density for a selected pulse duration, wherein each current pulse is followed by an interpulse period wherein the current density is set to 0, wherein the interpulse period is at least 0.1 seconds and wherein the pulse duration is at least 0.1 seconds.

2. The method according to claim 1, wherein the electrolyte solution consists of:

i) the trivalent chromium compound provided by a water-soluble chromium(III) salt wherein the electrolyte solution contains at least 50 mM and at most 1000 mM Cr3+-ions;

ii) a total amount of from 25 to 2800 mM of sodium sulphate or potassium sulphate;

iii) a formate salt as a complexing agent at a $$\left(\frac{\text{complexing agent}}{Cr^{3+}}\right)$$

molar ratio of at least 1:1 and at most 4.0:1;

iv) optionally sulphuric acid or sodium hydroxide or potassium hydroxide to adjust the pH to the desired value;

v) optionally a surfactant to facilitate the release of hydrogen gas bubbles from the substrate;

vi) remainder inevitable impurities.

3. The method according to claim 1, wherein the pH is adjusted to a value of 2.00 or more.

4. The method according to claim 1, wherein in the batch electrodeposition process the pulse duration is between 0.5 and 2.5 seconds, and wherein the interpulse period is between 0.5 and 5 seconds.

5. The method according to claim 1, wherein in the continuous electrodeposition process the pulse duration is between 0.5 and 2.5 seconds, and wherein the interpulse time is between 0.5 and 5 seconds.

6. The method according to claim 5, wherein the pulse duration in the continuous electrodeposition process is between 0.5 and 2 seconds, and wherein the interpulse time is between 0.5 and 2 seconds.

7. The method according to claim 1, wherein the water-soluble chromium(III) salt is basic chromium(III)sulphate and/or wherein the complexing agent is sodium formate.

8. The method according to claim 1, wherein the amount of chromium deposited is at least 1 g/m2.

9. The method according to claim 1, wherein the temperature of the electrolyte during electrodeposition is at least 35° C.

10. The method according to claim 1, wherein the line speed of the electrodeposition line in the continuous electrodeposition process is at least 50 m/min.

11. The method according to claim 1, wherein the molar complexing agent/Cr ratio is 2.0:1.

12. The method according to claim 1, wherein the metallic substrate is an unalloyed steel strip or sheet.

13. The method according to claim 12, wherein the metallic substrate is a nickel coated steel strip or sheet or a copper coated steel strip or sheet.

14. The method according to claim 1, to provide a metallic substrate with a functional or decorative chromium layer having a gloss value of at least 800 when measured under an angle of 20° in accordance with ISO 2813:2014.

15. The method according to claim 1, to provide a metallic substrate with a functional chromium layer for use in a photovoltaic application the chromium layer having a thickness of between 75 and 1000 nm.

16. A method of producing a photovoltaic device comprising including in the photovoltaic device the metallic substrate with the functional chromium layer produced according to claim 14.

17. The method according to claim 16, wherein the photovoltaic application is a solar cell.

18. The method according to claim 15, wherein the chromium layer has a gloss value of at least 800 when measured under an angle of 20° in accordance with ISO 2813:2014.

19. The method according to claim 1, wherein the pH is adjusted to a value of 2.00 or more, and to a value of 2.75 or less.

* * * * *